US009724815B2

(12) United States Patent
Zhen et al.

(10) Patent No.: US 9,724,815 B2
(45) Date of Patent: Aug. 8, 2017

(54) PORTABLE POWER TOOL WITH IMPROVED BRAKE ASSEMBLY

(75) Inventors: Bo Zhen, Hangzhou (CN); Aigui Wang, Hangzhou (CN); Songtao Jin, Hangzhou (CN)

(73) Assignee: Bosch Power Tools (China) Co., Ltd., Hangzhou, Zhejiang (CN)

( * ) Notice: Subject to any disclaimer, the term of this patent is extended or adjusted under 35 U.S.C. 154(b) by 998 days.

(21) Appl. No.: 13/814,958

(22) PCT Filed: Aug. 11, 2010

(86) PCT No.: PCT/CN2010/075893

§ 371 (c)(1),
(2), (4) Date: Apr. 18, 2013

(87) PCT Pub. No.: WO2012/019345

PCT Pub. Date: Feb. 16, 2012

(65) Prior Publication Data

US 2013/0292148 A1 Nov. 7, 2013

(51) Int. Cl.
*B25F 5/00* (2006.01)
*B24B 23/02* (2006.01)

(52) U.S. Cl.
CPC ..... *B25F 5/00* (2013.01); *B24B 23/02* (2013.01); *B25F 5/001* (2013.01)

(58) Field of Classification Search
None
See application file for complete search history.

(56) References Cited

U.S. PATENT DOCUMENTS 2,898,956 A * 8/1959 Zern ..... B24B 23/02 144/136.1
3,472,323 A * 10/1969 Hall ..... A61B 17/1626 173/221
3,642,104 A * 2/1972 Schafer ..... F16D 55/00 188/171
3,659,170 A * 4/1972 Burkett ..... H02K 7/1026 310/77

(Continued)

FOREIGN PATENT DOCUMENTS

CN 2302078 Y 12/1998
CN 2767056 Y 3/2006

(Continued)

OTHER PUBLICATIONS

International Search Report corresponding to PCT Application No. PCT/CN2010/075893, mailed May 19, 2011 (English language document) (5 pages).

*Primary Examiner* — Hemant M Desai
*Assistant Examiner* — Mobeen Ahmed
(74) *Attorney, Agent, or Firm* — Maginot, Moore & Beck LLP

(57) ABSTRACT

A portable power tool includes a motor housing and a motor mounted in the motor housing. The motor includes a rotary spindle. The portable power tool also includes a trigger configured to be actuated and released to switch on and off the motor. The portable power tool also includes a mechanical brake assembly connected with the trigger and automatically operated by the trigger. Accordingly, the brake assembly releases the spindle when the trigger is activated and brakes the spindle when the trigger is released.

11 Claims, 2 Drawing Sheets

(56) References Cited

U.S. PATENT DOCUMENTS 3,760,570 A * 9/1973 Ehrlich ..... A01D 34/6812 188/185
4,029,159 A * 6/1977 Nymann ..... B23Q 11/0092 173/217
4,063,625 A 12/1977 Hansson
4,480,205 A * 10/1984 Nymann ..... F16D 49/00 310/48
4,662,072 A * 5/1987 Wieland ..... F16D 59/00 188/77 R
4,734,604 A * 3/1988 Sontheimer ..... H02K 7/125 188/171
5,094,000 A * 3/1992 Becht ..... B23Q 11/0092 188/71.1
5,261,233 A * 11/1993 Kishi ..... B24B 23/026 173/156
5,480,009 A * 1/1996 Wieland ..... B27B 17/083 188/105
5,879,111 A * 3/1999 Stock ..... B25D 16/003 408/124
6,010,426 A * 1/2000 Nakamura ..... B25F 5/001 188/189
6,454,020 B1 * 9/2002 Jong ..... B25B 21/00 173/104
7,168,502 B2 1/2007 Hartmann
2002/0020264 A1 * 2/2002 Hartmann ..... B25F 5/001 83/58
2002/0024311 A1 * 2/2002 Hartmann ..... B25F 5/001 318/560
2005/0092149 A1 * 5/2005 Hartmann ..... B25F 5/001 83/58
2007/0205077 A1 * 9/2007 Nakamura ..... B25F 5/001 192/116.5
2008/0289924 A1 * 11/2008 Stehle ..... B25F 5/00 188/77 R

FOREIGN PATENT DOCUMENTS

DE 42 39 559 A1 5/1994
JP 2004-249420 A 9/2004

* cited by examiner

PORTABLE POWER TOOL WITH IMPROVED BRAKE ASSEMBLY

This application is a 35 U.S.C. §371 National Stage Application of PCT/CN2010/075893, filed on Aug. 11, 2010, the disclosure of which is incorporated herein by reference in its entirety.

The disclosure relates to a portable power tool having an improved brake assembly which shuts down the power tool quickly after operation.

BACKGROUND

Portable power tools having rotational output are widely used. Many portable power tools do not have brake function. Generally, after the operation of a portable power tool, an operator has to hold the power tool for a period of time until the spindle of the power tool is totally stopped. Then, the operator can put the tool down. This is time-consuming and not convenient for the operator. In addition, it has a high risk of injury. Specifically, if the operator puts down the tool when the spindle of the tool is still rotating, the tool may hurt other items or people.

For addressing this problem, some portable power tools are equipped with a brake for stopping the tool quickly and smoothly, which gives the operator higher safety and better feeling.

In the prior art, one solution for stopping the tool is using an electrically controlled brake for providing a braking force to the power tool. The tool comprises a braking module, located between a motor and a power supply, for applying a current limited braking force to the motor when the power supply is disconnected from the motor. The electrically controlled brake has high cost and low reliability.

Another solution is using a mechanical brake, like the brakes adopted in vehicles. Specifically, a brake wheel is fixed on a motor spindle of the power tool, and a lever covered with rubber is adapted to contact and stop the brake wheel under the force of a compression spring. The manipulation of the mechanical brake is independent of the operation of the motor. That is to say, after the operation of the tool, the operator needs to perform an additional action to stop the tool. This is cumbersome.

Further, sometimes it needs that, after the operation of the tool, the spindle of the tool is locked from rotation for the purpose of, for example, exchanging the tool head or tool bit which is driven by the spindle. Although conventional power tools with brake can stop quickly after operation, their spindles are not locked in place from rotation.

Thus, it is desirable to provide a portable power tool with a simple and reliable brake, which can stop the spindle of the tool quickly and smoothly after operation and lock the spindle to prevent it from rotation.

SUMMARY

In view of the problems existed in the prior art, an object of the disclosure is to provide a portable power tool having an improved brake which functions as both a brake and spindle locking means.

For achieving this object, in one aspect, the present disclosure provides a portable power tool comprising:

a motor housing, a motor mounted in the motor housing and having a rotary spindle, a trigger adapted to be actuated and released for switching on and off the motor respectively, and a mechanical brake assembly connected with the trigger and automatically operated by the trigger such that the brake assembly releases the spindle when the trigger is activated and performs brake to the spindle when the trigger is released.

In accordance with a preferred embodiment of the disclosure, the brake assembly comprises a brake disc attached to the spindle, and a spindle lock carrying a friction material and being able to move in a first direction towards and away from the brake disc by means of the action of the trigger such that:

when the trigger is released, the spindle lock is moved towards the brake disc to bring the friction material into close contact with the brake disc, and when the trigger is actuated, the spindle lock is moved away from the brake disc to bring the friction material out of contact with the brake disc.

In accordance with another preferred embodiment of the disclosure, the portable power tool further comprises a fan mounted to the spindle, wherein the brake disc is fixed to the base of the fan.

In accordance with another preferred embodiment of the disclosure, the first direction is parallel to the rotation axis of the spindle.

In accordance with another preferred embodiment of the disclosure, the portable power tool further comprises a slide rod which is slidably moved by the trigger and comprises a motion transmit mechanism for transmitting the movement of the slide rod into the movement of the spindle lock with respect to the brake disc.

In accordance with another preferred embodiment of the disclosure, the moving direction of the slide rod is perpendicular to that of the spindle lock, and the motion transmit mechanism is a cam portion of the slide rod.

In accordance with another preferred embodiment of the disclosure, the spindle lock is formed in a substantially flat shape extending in a plane perpendicular to the rotation axis of the spindle.

In accordance with another preferred embodiment of the disclosure, the portable power tool further comprises first returning means, such as an elastic member, e.g., a spring, which biases the spindle lock towards the brake disc.

In accordance with another preferred embodiment of the invention disclosure, the portable power tool further comprises a spindle locking member for temporarily locking the spindle from rotation. The spindle locking member may be a metal ring fixed to the spindle.

In accordance with another preferred embodiment of the disclosure, the portable power tool further comprises a spindle locking member for temporarily locking the spindle from rotation, the spindle locking member being a nut for fastening the fan to the spindle.

In accordance with another preferred embodiment of the disclosure, the spindle lock is provided with a protrusion protruding towards the spindle locking member, and the spindle lock is also manually moveable in a second direction towards and away from the spindle locking member to bring protrusion into contact with and away from the spindle locking member.

In accordance with another preferred embodiment of the disclosure, the portable power tool further comprises second returning means, such as an elastic member, e.g., a spring, which biases the spindle lock away from the spindle locking member.

In accordance with another preferred embodiment of the disclosure, the second direction is perpendicular to the rotation axis of the spindle.

The disclosure provides a portable power tool having a new mechanical brake assembly which is kinematically coupled with and automatically operated by the trigger. Thereby, the brake assembly of the disclosure is simple and easy to operate.

In addition, the spindle lock is able to be acted on the spindle by both the friction material which is cooperative with the brake disc as well as by the protrusion which is cooperative with the spindle locking member. Thus, the action area between the spindle lock and the spindle is large, which results in smooth, quick and reliable braking and locking.

This brake concept of the disclosure can be used on circular saws, angle grinders, marble cutters, and such power tools whose output is rotation.

BRIEF DESCRIPTION OF THE DRAWINGS

The disclosure will be further understood by reading the following detailed description with reference to the drawings in which.

DETAILED DESCRIPTION

Now, a portable power tool according to a preferred embodiment of the disclosure will be described with reference to FIGS. 1 to 3.

Figure 1:
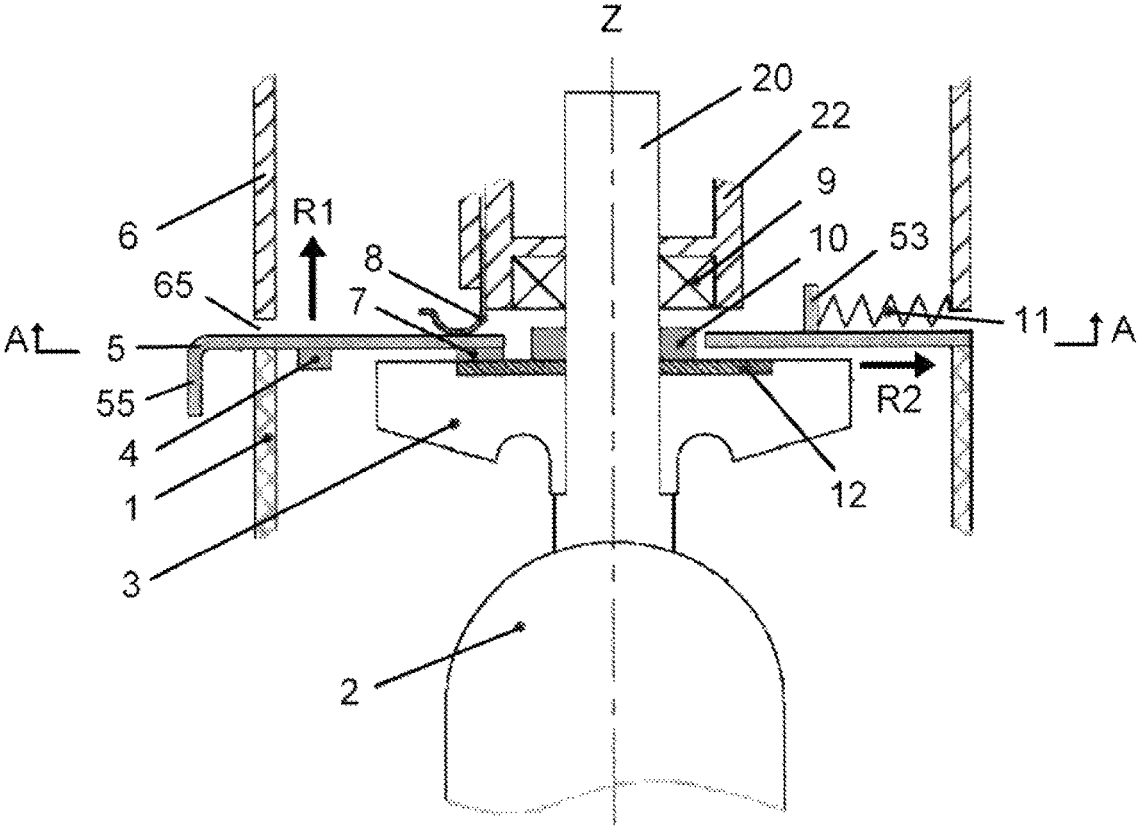
FIG. 1 is a schematic cross-sectional view showing a part of a portable power tool according to an embodiment of the disclosure.

As shown in FIG. 1, the portable power tool mainly comprises a motor housing 1, a motor 2 fixedly mounted in the motor housing and having a rotary spindle 20 which defines a rotation axis Z, a fan 3 fixedly mounted around the rotary spindle 20 within the motor housing by a nut 10, so as to be rotated by the spindle for cooling the motor, and a guard 6 mounted to the motor housing near a tool head (not shown) to be attached to the tip end of the spindle for preventing work piece fragments from reaching the operator of the tool.

The spindle 20 is rotatably supported near its tip end by a front bearing 9, which in turn is carried by a supporting structure 22 fixed to or integrally formed with the motor housing 1 or the guard 6.

The portable power tool further comprises a brake assembly for stopping the rotation of the spindle after the operation of the tool is ended and locking the spindle from rotation.

The brake assembly mainly comprises a slide rod 4, a spindle lock 5, a friction material pad 7, a returning spring (such as one or more leaf springs) 8 and a brake disc 12, which will be described below.

The brake disc 12 is attached to a base face of the fan 3 in any manner known in the art, for example, clamped between the nut 10 and the base face of the fan 3.

The spindle lock 5 is formed in a substantially flat plate shape extending in a plane perpendicular to the rotation axis Z of the spindle 20 and is provided at a position in direction of the rotation axis Z corresponding to that of the nut 10. The spindle lock 5 is moveably mounted near the front end of the motor housing 1, elongated in an X direction which is perpendicular to the rotation axis Z of the spindle 20. The spindle lock 5 has an enlarged hollow middle portion 52 which surrounds the spindle 20 and the nut 10, and a protrusion 56 protruding in the X direction from the middle portion 52 towards the nut 10. The nut 10 has a polygonal, preferably regular polygonal profile, so as to provide a planar side to be abutted by the protrusion 56.

Figure 3:
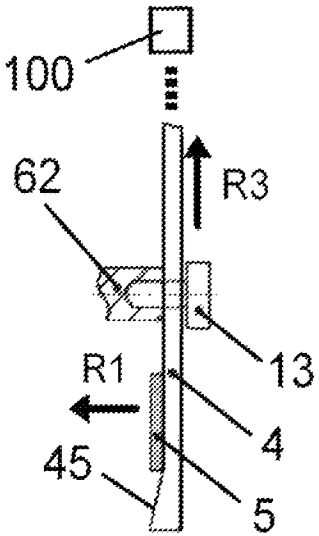
FIG. 3 is a schematic view showing a part of the brake assembly in the direction indicated by arrow B in FIG. 2.
Figure 2:
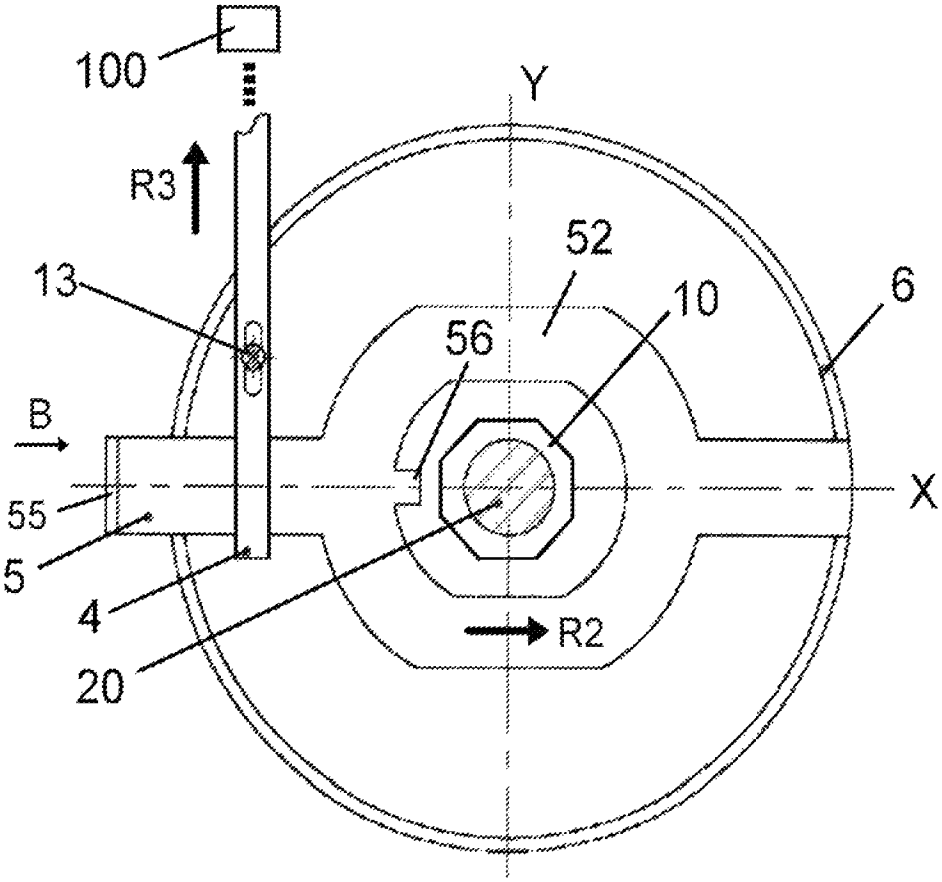
FIG. 2 is a schematic view of the brake assembly of the portable power tool in the direction indicated by arrows A-A in FIG. 1.

The spindle lock 5 is movable in Z direction as indicated by arrow R1 in FIGS. 1 and 3, and movable in X direction as indicated by arrow R2 in FIGS. 1 and 2.

The movement of the spindle lock 5 in Z direction is actuated by the cam action of the slide rod 4, as will be described below. Opposing notches 65 are formed through the back end of the guard 6 for permitting the movement of the spindle lock 5 in Z direction. The returning spring 8 is fixed to the supporting structure 22 and normally biases the spindle lock 5 in a reverse direction opposite to arrow R1.

The spindle lock 5 has an end (left end in FIGS. 1 and 2) protruded out from the motor housing 1 and formed by bending as a pushing tab 55. By pushing this pushing tab 55, the spindle lock 5 is moved in X direction as indicated by arrow R2.

A return spring 11, which is a compression spring in the illustrated embodiment, is clamped between a protrusion 53 of the spindle lock 5 and the inner wall surface of the guard 6 and normally biases the spindle lock 5 in a reverse direction opposite to arrow R2.

The friction material pad 7 is attached to the backside of the middle portion 52 of the spindle lock 5 opposing to the brake disc 12. In the normal state of the spindle lock 5, the friction material pad 7 is clamped between the middle portion 52 and the brake disc 12 under the biasing force of the returning spring 8. Meanwhile, the spindle lock 5 is biased by the return spring 11 in the reverse direction opposite to arrow R2 so that the protrusion 56 is away from periphery of the nut 10.

As shown in FIGS. 2 and 3, the movement of the spindle lock 5 in the direction of arrow R1 is activated by the slide rod 4. The slide rod 4 is slidable in a Y direction perpendicular to both the X direction and Z direction, as indicated by arrow R3 in FIGS. 2 and 3.

The slide rod 4 is slidably attached to a supporting portion 62 of the guard 6 by a screw 13.

The slide rod 4 has a cam portion 45 which pushes the spindle lock 5 to move in the direction of arrow R1 when the slide rod 4 is moving in the direction of arrow R3.

The slide rod 4 is kinematically connected to a switch trigger 100 (schematically shown in FIGS. 2 and 3). By actuating of the switch trigger, it will pull the slide rod in the direction of arrow R3. Returning means, such as a returning spring, is provided for the slide rod 4 for moving it towards its original position in a reverse direction opposite to arrow R3 when the switch trigger has been released.

According to the above described portable power tool, the brake disc 12 is fixed to the fan 3, the friction material pad 7 is fixed to the spindle lock 5, and the slide rod is connected to the switch trigger. In the non-working state of the tool, the friction material pad 7 is pushed against the brake disc 12 by the pushing force of the returning spring 8, so that the tool is in a brake state.

When the operator operates the tool by actuating the switch trigger, the switch trigger pulls the slide rod 4 in the direction of arrow R3 against the pushing force of the returning spring 8 so that the cam portion 45 pushes the spindle lock 5 to move in the direction of arrow R1. Thus, the friction material pad 7 moves away from the brake disc 12, and now the spindle 20 is free to rotate. Meanwhile, the motor 2 is turned on by the actuating of the switch trigger, and the spindle 20 rotates to drive the tool head to perform an operation. During the operation of the tool, the operator keeps the switch trigger actuated.

When the operation of the tool is ended or should be stopped, the operator releases the switch trigger. As a result, the slide rod 4 is moved towards its original position by its returning means in a reverse direction opposite to arrow R3 so that the cam portion 45 moves away from the spindle lock 5. The spindle lock 5 moves in the reverse direction opposite to arrow R1 under the pushing force of the returning spring 8 and thus the friction material pad 7 comes into contact with and pushes against the brake disc 12. In this way, the spindle 20 is stopped quickly and smoothly.

On the other hand, if it needs to remove the tool head or tool bit (not shown) attached to the spindle 20 for the purpose such as replacement or service, the operator may push down the spindle lock 5 in the direction of arrow R2 by means of the pushing tab 55. By this action, the protrusion 56 comes into contact with the planar side of the nut 10 to lock the spindle 20 from rotation. In this way, the nut 10 forms a spindle locking member. Other structures for this locking member are also applicable, if they can cooperate with the protrusion 56 to lock the spindle 20 from rotation. For example, the spindle locking member may be a metal ring fixed to the spindle.

After the tool head or tool bit has been removed, the operator may release the pushing tab 55. Thus, the spindle lock 5 is moved by the return spring 11 in the reverse direction opposite to arrow R2 so that the protrusion 56 moves away from periphery of the nut 10.

The basic concept of the disclosure is providing a mechanical brake assemble for the portable power tool. The brake assembly is connected with the trigger and automatically operated by the trigger such that the brake assembly releases the spindle when the trigger is activated and performs brake to the spindle when the trigger is released. Any structures that can constitute a mechanical brake assembly having the above functions fall within the scope of the disclosure.

While certain embodiments have been described, these embodiments have been presented by way of example only, and are not intended to limit the scope of the disclosures. The attached claims and their equivalents are intended to cover all the modifications, substitutions and changes as would fall within the scope and spirit of the disclosure.

The invention claimed is:

1. A portable power tool comprising:

a motor housing;

a motor mounted in the motor housing, the motor including a rotary spindle defining an axis of rotation;

a trigger configured to be actuated and released to switch on and off the motor, respectively; and a brake assembly connected with the trigger and automatically operated by the trigger such that the brake assembly releases the spindle when the trigger is activated and brakes the spindle when the trigger is released, the brake assembly including:

a brake disc attached to the spindle, the brake disc having a planar braking surface which is perpendicular to the axis of rotation;

a slide rod coupled to the trigger, the slide rod being configured to move in a first direction from a first position to second position when the trigger is activated, the first direction being substantially perpendicular to the axis of rotation, and to return to the first position when the trigger is released, the slide rod including a motion transmit mechanism; and a spindle lock positioned to be engaged by the motion transmit mechanism as the slide rod moves from the first position to the second position, wherein the spindle lock includes a friction material that is positioned in engagement with the braking surface to apply a braking force when the slide rod is in the first position, and wherein, when the slide rod is moved from the first position to the second position by the trigger, the a motion transmit mechanism engages the spindle lock and pushes the spindle lock in a second direction, the second direction being substantially parallel to the axis of rotation and away from the brake disc such that the friction material is moved away from the braking surface.

2. The portable power tool of claim 1, further comprising a fan mounted to the spindle, wherein the brake disc is fixed to a base of the fan.

3. The portable power tool of claim 1, wherein:

the motion transmit mechanism is a cam portion of the slide rod.

4. The portable power tool of claim 3, wherein the spindle lock is a substantially flat shape extending in a plane perpendicular to the axis of rotation.

5. The portable power tool of claim 1, further comprising a first returning mechanism, configured to bias the spindle lock towards the brake disc.

6. The portable power tool of claim 1, further comprising a spindle locking member configured to temporarily lock the spindle from rotation.

7. The portable power tool of claim 2, further comprising a spindle locking member configured to temporarily lock the spindle from rotation, the spindle locking member being a nut configured to fasten the fan to the spindle.

8. The portable power tool of claim 6, wherein:

the spindle lock has a protrusion protruding towards the spindle locking member, and the spindle lock is manually moveable towards and away from the spindle locking member to bring the protrusion into contact with and away from, respectively, the spindle locking member.

9. The portable power tool of claim 5, further comprising a second returning mechanism, configured to bias the spindle lock away from the spindle locking member.

10. The portable power tool of claim 8, wherein the portable power tool is one of a circular saw, an angle grinder, and a marble cutter.

11. A portable power tool comprising:

a motor housing;

a motor mounted in the motor housing, the motor including a rotary spindle defining an axis of rotation;

a trigger configured to be actuated and released to switch on and off the motor, respectively; and a brake assembly connected with the trigger and automatically operated by the trigger such that the brake assembly releases the spindle when the trigger is activated and brakes the spindle when the trigger is released, the brake assembly including:

a brake disc attached to the spindle, the brake disc having a planar braking surface which is perpendicular to the axis of rotation;

a spindle lock coupled to the trigger, the spindle lock being configured to move in a first direction from a first position to second position when the trigger is activated, the first direction being substantially parallel to the axis of rotation, and to return to the first position when the trigger is released; and a spindle locking member configured to temporarily lock the spindle from rotation, wherein the spindle lock includes a friction material that is positioned in engagement with the braking surface to apply a braking force when the spindle lock is in the first position, wherein the friction material is spaced apart from the brake disc when the spindle lock is in the second position, wherein the spindle lock has a protrusion protruding towards the spindle locking member, and wherein the spindle lock is manually moveable towards and away from the spindle locking member to bring the protrusion into contact with and away from, respectively, the spindle locking member.

* * * * *